US005374326A

United States Patent [19]

Marchetti

[11] Patent Number: 5,374,326

[45] Date of Patent: Dec. 20, 1994

[54] SEALING MACHINE WITH TWO SUPERIMPOSED SEALING UNITS FOR PARALLELEPIPED BOXES WITH DOWN-TURNED FLAPS WITH SIMPLIFIED ACCESS TO THE LOWER SEALING UNIT

[76] Inventor: Augusto Marchetti, Piazza Sicilia, 7, 20146 Milano, Italy

[21] Appl. No.: 92,890

[22] Filed: Jul. 19, 1993

[30] Foreign Application Priority Data

Jul. 17, 1992 [IT] Italy ..... MI92 A 001734

[51] Int. Cl.[5] ..... B32B 31/00

[52] U.S. Cl. ..... 156/468; 156/475; 156/486; 156/489; 53/137.2; 493/478

[58] Field of Search ..... 156/468, 475, 476, 477.1, 156/486–492, 518, 521, 522; 53/137.2, 415; 493/382, 383, 478, 479

[56] References Cited

U.S. PATENT DOCUMENTS

| | | | |
|---|---|---|---|
| 3,196,591 | 7/1965 | Guido et al. | 53/137 |
| 4,041,675 | 8/1977 | Loveland et al. | 53/76 |
| 4,060,442 | 11/1977 | Marchetti | 156/468 |
| 4,554,042 | 11/1985 | Marchetti | 156/468 |
| 4,572,760 | 2/1986 | Marchetti | 53/137.2 |
| 4,748,794 | 6/1988 | Marchetti | 493/478 |
| 4,781,786 | 11/1988 | Lerner et al. | 156/468 |
| 4,789,418 | 12/1988 | Rayl | 156/486 |
| 4,846,921 | 7/1989 | Lerner et al. | 156/468 |
| 5,025,608 | 6/1991 | Marchetti | 156/468 |

FOREIGN PATENT DOCUMENTS

| | | |
|---|---|---|
| 0179520 | 12/1988 | European Pat. Off. . |
| 92A000407 | 2/1992 | Italy . |

*Primary Examiner*—Michael W. Ball
*Assistant Examiner*—James J. Engel
*Attorney, Agent, or Firm*—Cushman Darby & Cushman

[57] ABSTRACT

A sealing machine for sealing parallelpiped boxes with down-turned flaps, comprises a lower supporting and containment structure defining a supporting plane for the boxes; a lower sealing unit normally contained within the supporting and containment structure; means for advancing the boxes along the supporting plane; a vertically movable upper supporting structure; and an upper sealing unit fixed to the upper supporting structure. The lower supporting structure includes a control unit operable externally from the sealing machine for enabling upward movement of the lower sealing unit to a position wherein at least a portion of the lower sealing unit is disposed above the supporting plane of the boxes.

7 Claims, 5 Drawing Sheets

SEALING MACHINE WITH TWO SUPERIMPOSED SEALING UNITS FOR PARALLELEPIPED BOXES WITH DOWN-TURNED FLAPS WITH SIMPLIFIED ACCESS TO THE LOWER SEALING UNIT

The present invention relates to a sealing machine having two superimposed sealing units for parallelepiped boxes with down-turned flaps, which sealing machine permits with simplified access to the lower sealing unit.

Sealing machines are known to be units used to seal the top and the bottom of cardboard boxes for which the closing flaps have already been turned down.

Numerous machines are known that carry out such sealing by using sections of plastic adhesive tape taken from a continuous roll.

However, ecological reasons have recently oriented some users, and consequently the manufacturers, toward sealing machines that use suitably moistened gummed paper instead of adhesive tape.

As described, for example, in the U.S. Pat. No. 4,554,042 and in the Italian patent application No. MI92A000407 dated Feb. 25, 1992, known sealing machines comprise a supporting base, means for the advancement of the boxes associated with said supporting base, as well as two sealing units, one upper and one lower, used for sealing the upper and lower surfaces of the boxes, respectively. Such sealing units are constructed in a different manner according to the type of sealing material (gummed paper or adhesive tape) used, but they are in any case generally designed so that it is the box itself that automatically determines the withdrawal, the cutting arid the application of the correct length of adhesive tape or gummed paper, In the known sealing machines the upper sealing unit is located above a base for supporting the boxes in a vertically displaceable manner, so that the sealing machine can be adapted to boxes of different heights. The adjustment in height of the upper sealing unit can be executed automatically by the machine by means of special devices or manually at each change of box size.

The lower sealing unit, on the other hand, is permanently housed in a space provided in the supporting base.

As regards the structure of the two upper and lower sealing units reference is made in particular to the above-mentioned Italian patent application and to the European patent No. 0179520 for sealing with gummed paper and with adhesive tape, respectively.

In sealing machines of the conventional type there are several drawbacks linked with maintenance operations, in particular as regards the lower sealing unit, since this is located inside the supporting structure of the sealing machine and can thus be reached by the operator only with difficulty.

The above-mentioned drawback refers both to operations of extraordinary maintenance (possible breakdowns, jamming of the adhesive tape or of the gummed paper, etc.), and those of ordinary maintenance (replacement of the adhesive tape or of the gummed paper, cleaning the machine, etc.).

The object of the present invention is to provide a sealing machine wherein access to the lower sealing unit for the corresponding maintenance operations is decidedly simplified.

According to the present invention such object is attained by means of a sealing machine comprising a lower supporting containment structure, wherein there is housed a lower sealing unit and that defines a supporting plane of the boxes, means advancement of the boxes along said supporting plane and an upper supporting structure that can be displaced vertically which there is fastened an upper sealing unit, characterized in that said lower supporting structure is provided with means that can be operated from the outside, suitable for allowing the upward movement of said lower sealing unit above said supporting plane of the boxes.

It is evident that in this way a sealing machine is obtained which simplifies maintenance on the lower sealing unit due to the effect of the greater accessibility of the unit.

In this respect it should be noted that, according to a preferred embodiment, the upward movement of the lower unit is subordinated to a prior upward movement of the upper unit, whose subsequent downward movement is, on the other subordinated to the subsequent downward movement of the lower unit. It follows that it is impossible for the upper sealing unit and the lower sealing unit to be damaged as a cot:sequence of an impact between them.

In addition, the machine according to the invention preferably has the supporting plane for the boxes provided with a part that may be extracted to make it easier to gain access to the roll of sealing material (adhesive tape or gummed paper), thus simplifying operations related with the replacement of the roll itself.

These and other features of the present invention shall be made more evident by the following detailed description of one of its embodiments, illustrated as non-limiting examples in the enclosed drawings, wherein.

Figure 1:
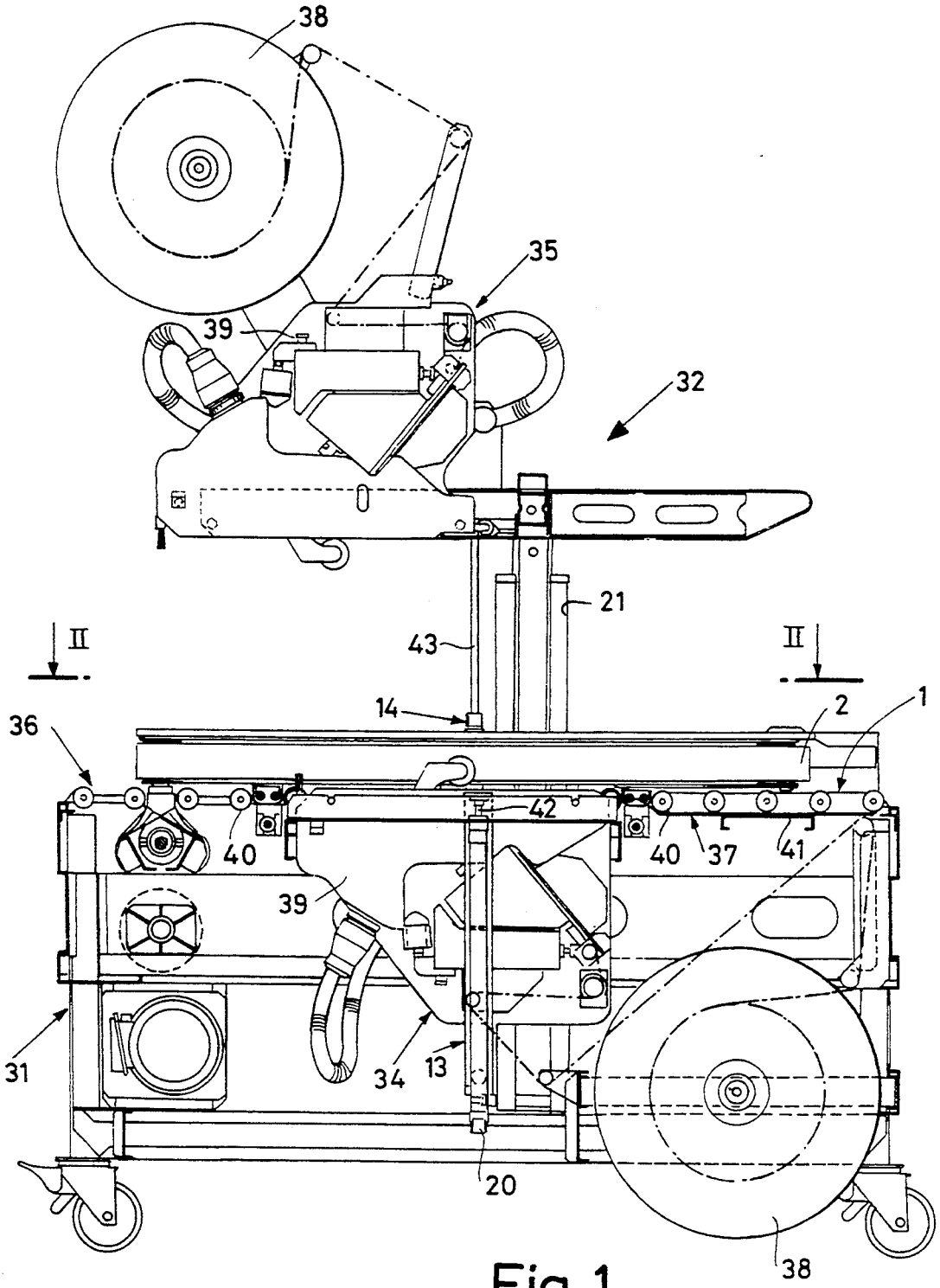
FIG. 1 shows a sealing machine according to the invention in a longitudinal sectional view, in an at-rest condition.

With reference to FIG. 1, the sealing machine according to the invention comprises essentially a lower structure 31 for the support and containment of a lower sealing unit 34. Over such structure 31 there is superimposed a roller frame 1 that defines a supporting plane for the boxes to be sealed. At the two sides of the frame 1 there are two belt units 2 for advancing the boxes. There is also an upper structure 32, for the support of an upper sealing unit 35. Said upper structure 32 can be displaced vertically to arrange itself at a variable distance from said roller frame 1, so as to allow the insertion of a box to be sealed between the upper structure 32 and the roller frame 1.

The lower sealing unit 34 and the upper sealing unit 35 have the function of applying a strip of adhesive tape, or equivalently of moistened gummed paper, along the slits that separate the closed lower and upper lateral flaps of the bottom and of the top of the boxes.

The structure of said lower 34 and upper 35 sealing units, known, for example, from the European patent No. 0179520 and from Italian patent application No. MI92A000407 dated Feb. 25, 1992, shall not be described here in detail. In any case, it is worth noting that these references disclose units which generally comprise a roll 38 of gummed paper or adhesive tape and a main casing 39, comprising various mechanisms for feeding and applying the sealing material.

The roller frame 1, superimposed over the lower containment structure 31 at the latter's upper surface can be relatively easily split into two main portions, 36 and the first of which is fixed, and the second of which can be extracted or removed.

Figure 2:
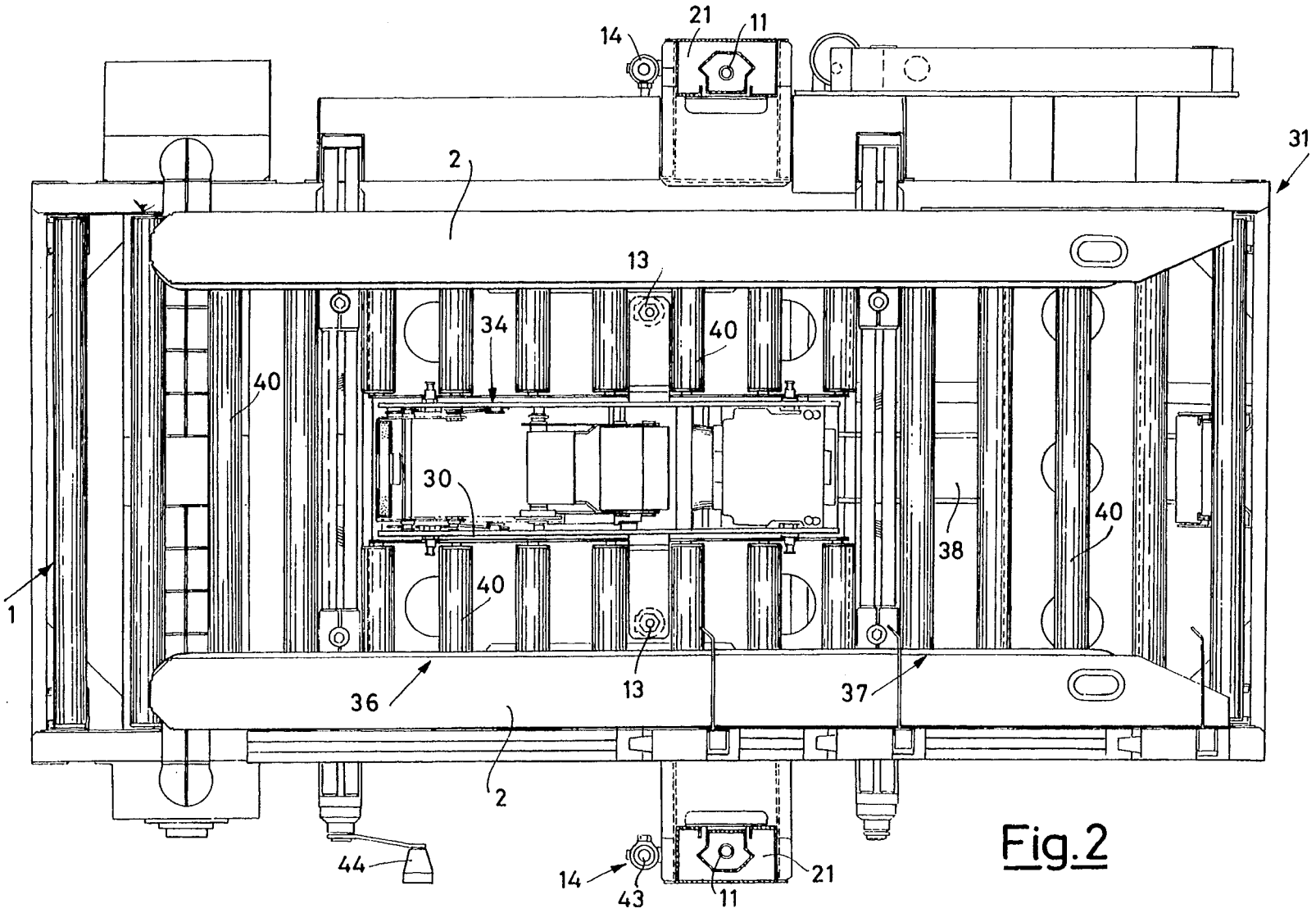
FIG. 2 is a sectional view of the sealing machine of FIG. 1, taken along the line II—II of FIG. 1.

Both the portions 36 and 37 are constituted by a succession of idle rollers 40 which function in facilitating the advancement of the boxes, as determined by the pair of lateral belts 2 superimposed over the frame 1. The belts 2 can be brought closer to one another by operating a crank 44 (FIG. 2) to engage with opposite sides of the boxes.

In the case of the removable portion 37, placed in a position superimposed over the feeding roll 38 of the lower sealing unit 34, said rollers 40 are mounted on a small supporting frame 41, that can be extracted or removed to allow an operator to gain easy access to the roll 38.

In the case of the fixed portion 36, at a position directly beneath the upper sealing unit 35, there is a window 30 (FIG. 2), that defines a space to receive the lower sealing unit.

The upper supporting structure 32 can be displaced vertically along two lateral uprights 21. The effect of its own weight tends to move the supporting structure 32 in a downwards direction while a pair of threaded vertical bars 11 (FIG. 2), if suitably operated through a crank (not shown) on the top of the same, are capable of raising the upper supporting structure to desired a height to allow the passage of the boxes.

The sealing machine according to the present invention is further provided with a central unit including a pair of pneumatic lifting cylinders 13, provided with stem 42, suitable for executing the upward movement of the lower sealing unit 34 from the position of FIG. 1. For this purpose, the cylinders 13 are arranged vertically inside the lower supporting structure 31 at the intervals between the rollers 34 of the part 36 of the roller frame 1 and fastened to such structure through pivots 20.

Parallel to such cylinders 13, but externally to structure 31, there is also a second pair of pneumatic lifting cylinders 14, each provided with stem 43 connected to the upper supporting structure 32.

Figure 5:
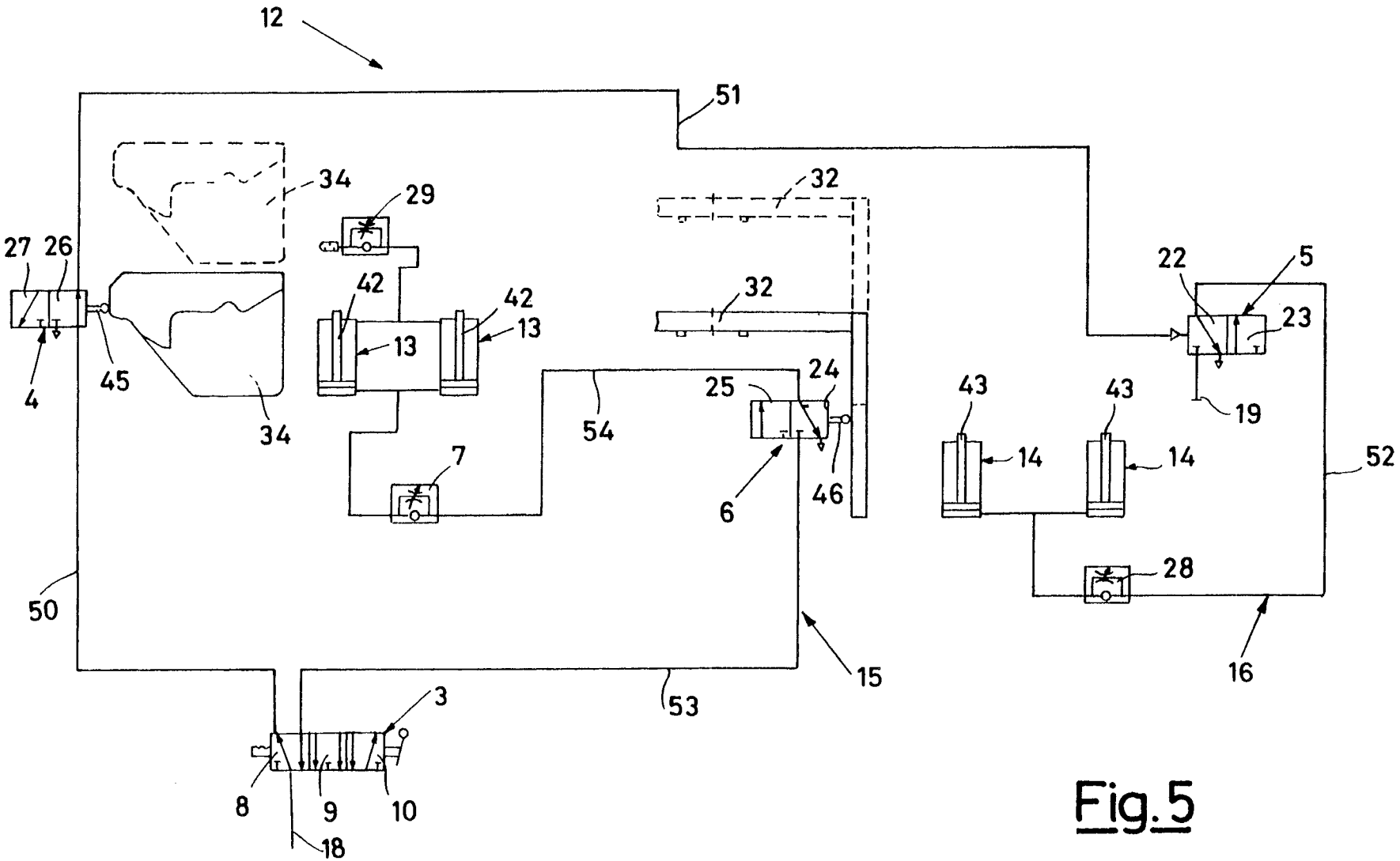
FIG. 5 shows a pneumatic operating and control diagram of the movement of the two sealing units.

The two pneumatic cylinders 13 and 14 can be connected to source of compressed air or to discharge, according to the operating conditions, and by operation of a pneumatic operating and control circuit 12 that is shown in detail in FIG. 5.

The pneumatic circuit 12 can be split into two main constituent parts 15 and 16. Of these, the first part 15 is directly accessible by the operator through a manual selector 3 that can be operated from a position or external to the machine outside and that receives its own power from a conduit 18; the second part 16, on the other hand, is powered and controlled by the above-mentioned first part, with which it communicates through a conduit 51, and is powered through a branch 19 of the conduit 18.

The part 15 of the pneumatic circuit 12 comprises, in addition to the abovementioned selector 3, a first two-way valve 4, provided with a sensor 45 for checking the position of the lower sealing unit 34, a second two-way valve 6 provided with a sensor 46 for checking the position of the upper supporting structure 32, and two flow regulators 7 and 29 provided with check valves.

The selector 3 is connected to the first two-way valve 4 through a first conduit 50, and to the second two-way valve 6 through a conduit 53. The first valve 4 is also connected to the second part 16 of the circuit through the conduit 51; the second valve 6 is, on the other hand, connected through a conduit 54 to the two cylinders 13, upstream and downstream from which there are the two flow regulators 7 and 29, respectively.

The second part 16 of the pneumatic circuit 12 comprises, a two-way valve 5, powered by the branch 19 of the conduit 18, and a flow regulator 28, connected together and to the cylinders 14 (positioned downstream from said flow regulator 28) through a conduit 52.

The operation of the sealing machine illustrated in the drawings is not described here, being that the sealing machine is of a widely-known type, for example as described in the European patent and in the Italian patent application mentioned earlier.

As regards access to the lower sealing unit for operations of maintenance and reloading the same, the sealing machine according to the present invention is, on the other hand, different from known machines in that it works as follows.

The upward movement of the two sealing units can be operated, as already mentioned, through the pneumatic circuit 12 illustrated in FIG. 5.

Figure 3:
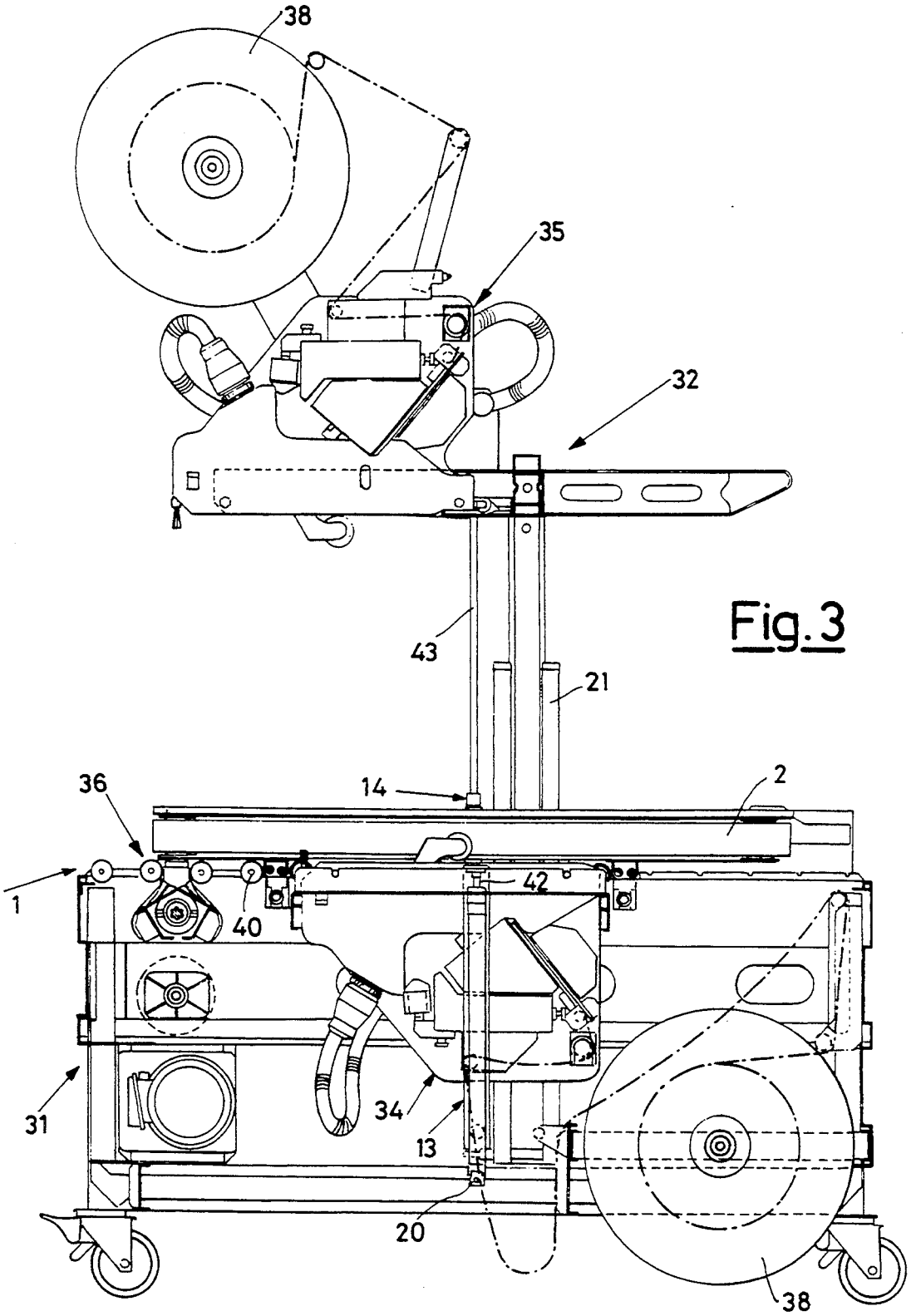
FIG. 3 shows the sealing machine of FIG. 1 in a longitudinal sectional with the upper sealing unit displaced vertically upward.
Figure 4:
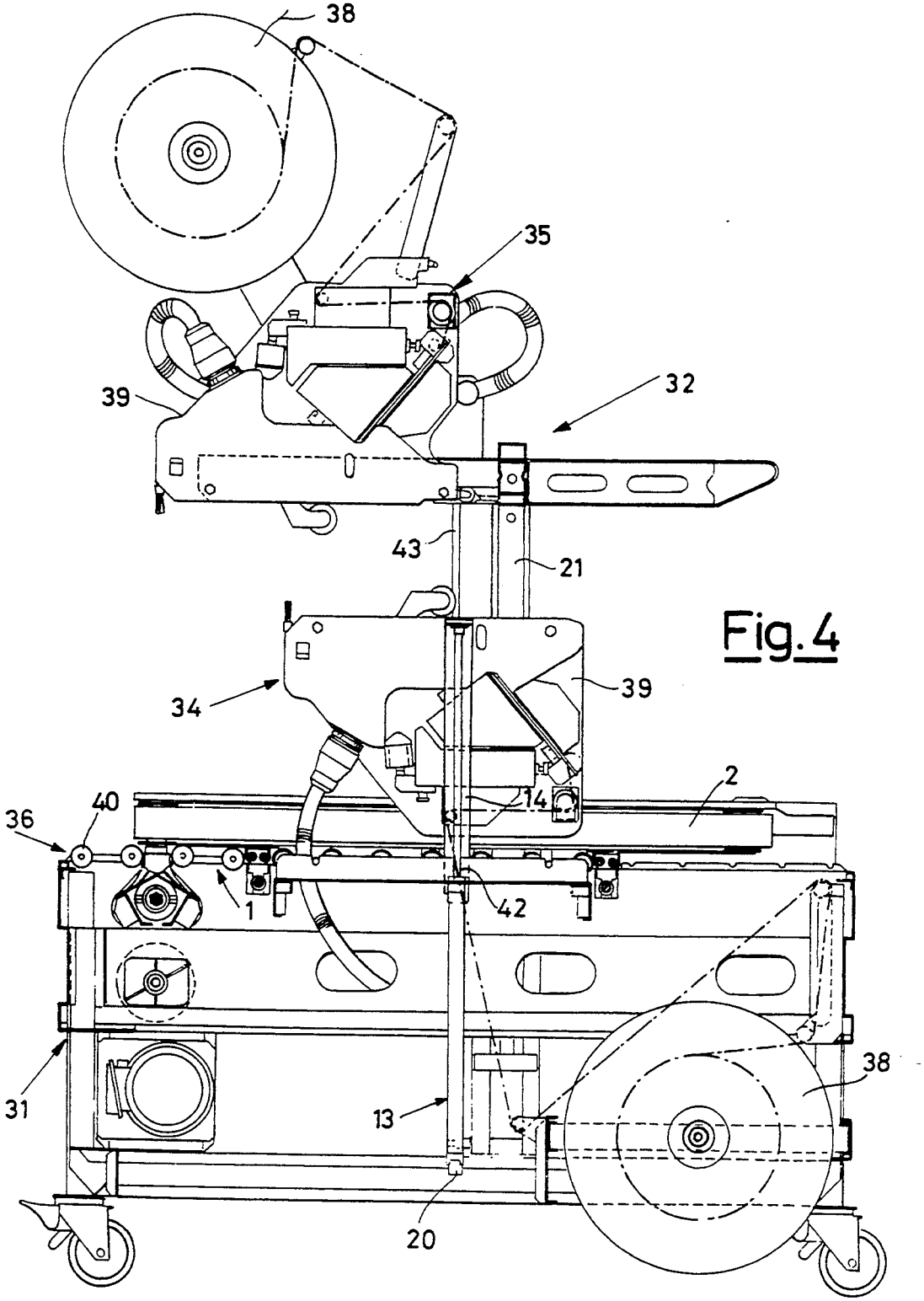
FIG. 4 shows the sealing machine of FIG. 1 again in a longitudinal sectional view, with the lower sealing unit extracted from its position.

The pneumatic circuit 12 can be activated and powered by the operator through the manual selector 3, that can have three positions, as indicated by numerals 8, 9 and 10 in FIG. 5 respectively, for keeping the two units at rest (FIG. 1), for the upward movement of the upper sealing unit (FIG. 3) and for the upward movement of the lower sealing unit (FIG. 4).

With reference to FIG. 5, when the selector is in position 8, compressed air introduced through the conduit 18, through the conduit 50, can reach the two-way valve 4 that, through the sensor 45, checks the position of the lower sealing unit 34. Since this is in the at rest position, that is, it is inside the receiving space 30, the above-mentioned valve 4 is consequently in position 26 and allows the passage of compressed air that, through the conduit 51, reaches the valve 5.

The valve 5 can assume the two positions 22 and 23, corresponding to the condition of rest (FIG. 1) and to the upward movement of the upper sealing unit 35 (FIGS. 3 and 4), respectively, and remains in position 22 until compressed air is present in conduit 51. In such a condition, conduit 52 is connected to discharge and cylinders 14 are not activated.

The same can be said regarding conduits 53 and 54, both of which are connected to discharge, the first because selector 3 is in position 8 and the second because valve 6, detecting the lowered condition of the upper supporting structure 32 with the sensor 46, is in position 24 as shown in FIG. 5. Thus cylinders 13 are also not activated.

When selector 3 is in the position indicated by numeral 9 in FIG. 5, conduit 50 and, thus, 51 are connected to discharge, while power conduit 18 is closed. This causes the displacement of valve 5 to position 23. It follows that conduit 52 can now receive compressed air from the power source 19 and move it to the cylinders 14 thus causing the upward movement of the upper supporting structure 32 of the sealing machine through the upward movement of stems 43 (FIG. 3).

In this position, by taking away the removable part 37 of the roller frame, it is possible to gain access to the roll 38 of the lower sealing unit 34 for it to be replaced if depleted.

Following the upward movement of such structure 32, the sensor 46 of the valve 6 is no longer in contact with the structure itself, and as a consequence, causes the displacement of the operational position of the two-way valve 6, that goes from the initial position indicated by numeral 24 to that indicated by numeral 25 in FIG. 5, and that connects the conduits 53 and 54 together.

In this way, when the operator further moves selector 3 by taking it to position 10, compressed air from conduit 18 and moved through conduit 53 can reach conduit 54 and then cylinders 13 which thus cause the upward movement of the lower sealing unit 34 (FIG. 4).

The upward speed of the lower sealing unit 34 is regulated through the flow regulator 29.

The prior upward movement of the upper supporting structure 32 allows the lower sealing unit 34 to leave its receiving space 30, avoiding any possibility of collision.

The upward movement of the lower sealing unit 34, detected by sensor 45 of valve 4, causes the displacement of valve 4 from position 26 to position 27. In this position valve 4 closes conduit 50 and connects conduit 51 directly to discharge. It follows that, if by mistake the operator takes selector 3 back to position 8 before the cylinders 13 are lowered, valve 5 cannot under any circumstance move to position 22, so that the cylinders 14 and, thus, the upper supporting structure 32, remain raised above supporting plane 1 with no risk of collisions between the upper sealing unit 35 and the lower sealing unit 34.

In this condition (FIG. 4) it is possible to gain access freely and with ease to the two sealing units 34 and 35 for maintenance operations of any kind. When the removable part of the roller frame 1 is taken away it is possible, on the other hand, to gain easy access to the roll 38 of the lower sealing unit 34 for its replacement if depleted.

To return the machine to the normal operating condition it is necessary to go through the steps described above in the opposite direction, that is moving selector 3 first to position 9, then to position 8.

Displacement to position 9 connects cylinders 13 to discharger that return to the at rest position, and consequently cause the lower sealing unit 34 (FIG. 3) to move downward, at a speed regulated by the flow regulator 7. The sensor 45, once again in contact with the lower sealing unit 34, again takes two-way valve 4 to the initial position 26.

If selector 3 is further moved to position 8, compressed air is once again introduced in conduit 50 and is taken through conduit 51 to valve 5, that is once again placed in position 22, thus connecting cylinders 14 to discharge. These slowly lower the upper supporting structure 32, discharging through flow regulator 28 (FIG. 1).

The displacement of the supporting structure 32, detected by sensor 46, is followed by the return of the two-way valve 6 to the initial position 24.

I claim:

1. A sealing machine for sealing flaps of parallelpiped boxes with gummed paper or adhesive tape, comprising:

a lower supporting and containment structure defining a supporting plane for said boxes;

a lower sealing unit normally contained within said supporting and containment structure;

means for advancing the boxes along said supporting plane;

a vertically movable upper supporting structure; and an upper sealing unit fixed to said upper supporting structure;

said lower supporting structure including means operable externally from the sealing machine for enabling upward movement of said lower sealing unit to an upper position wherein at least a portion of said lower sealing unit is disposed above said supporting plane of the boxes.

2. The sealing machine according to claim 1, further comprising means operable externally from the sealing machine for enabling upward movement of said upper supporting structure to a position wherein it permits unobstructed movement of the lower sealing unit upon upward movement of the lower sealing unit to said upper position.

3. The sealing machine according to claim 2, wherein said means for enabling upward movement of said lower sealing unit and said means for enabling upward movement of said upper supporting structure are cooperable with one another so that:

i) said lower sealing unit will move to said upper position only after said upper supporting structure is moved to said position wherein it permits unobstructed upward movement of said lower sealing unit, and so that ii) the said upper supporting structure will move in the downward direction only when said lower sealing unit is in a position below said supporting plane of the boxes.

4. The sealing machine according to claim 3, wherein said means for enabling the upward movement of said lower sealing unit and said means for enabling the upward movement of the upper supporting structure each comprise at least one pneumatic cylinder supported by said lower supporting structure and functionally controlled through a pneumatic circuit having a manual control selector.

5. The sealing machine according to claim 4, wherein said pneumatic circuit comprises two-way valves having sensors constructed and arranged to subordinate the upward movement of said lower sealing unit to that of said upper supporting structure and to subordinate the downward movement of said upper supporting structure to that of said lower sealing unit.

6. The sealing machine according to claim 1, further comprising a feed roll of said tape disposed within said supporting and containment structure, and wherein said supporting and containment structure comprises a movable portion which is movable into a position wherein it access to said feed roll.

7. A sealing machine for sealing flaps of parallelpiped boxes with gummed paper or adhesive tape, comprising:

a lower supporting and containment structure having a supporting plane upon which said boxes travel during a sealing operation;

a lower sealing unit normally contained within said supporting and containment structure;

an upper supporting structure disposed above said lower supporting and containment structure, said upper supporting structure being movable to a position which enables said boxes to be disposed between said lower supporting and containment structure and said upper supporting structure;

an upper sealing unit fixed to said upper supporting structure; and a control unit operable externally from the sealing machine for enabling upward movement of said lower sealing unit to an upper position wherein at least a portion of said lower sealing unit is disposed above said supporting plane upon which said boxes travel during said sealing operation.

* * * * *